US008115129B2

(12) United States Patent
Tetik et al.

(10) Patent No.: US 8,115,129 B2
(45) Date of Patent: Feb. 14, 2012

(54) SWITCHING DEVICE

(75) Inventors: Adolf Tetik, Vienna (AT); Roman Kolm, Gr. Reichenbach (AT)

(73) Assignee: Moeller Gebäudeautomation GmbH, Schrems (AT)

( * ) Notice: Subject to any disclaimer, the term of this patent is extended or adjusted under 35 U.S.C. 154(b) by 322 days.

(21) Appl. No.: 12/397,868

(22) Filed: Mar. 4, 2009

(65) Prior Publication Data

US 2009/0260967 A1 Oct. 22, 2009

Related U.S. Application Data

(60) Provisional application No. 61/033,906, filed on Mar. 5, 2008.

(30) Foreign Application Priority Data

Mar. 5, 2008 (AT) ..... A 360/2008

(51) Int. Cl.
*H01H 5/00* (2006.01)

(52) U.S. Cl. ..... 200/400
(58) Field of Classification Search ..... 200/400, 200/202, 293–303, 558; 335/35, 132, 172, 335/202, 23, 167, 176, 42
See application file for complete search history.

(56) References Cited

U.S. PATENT DOCUMENTS

| | | | | |
|---|---|---|---|---|
| 4,679,016 | A * | 7/1987 | Ciarcia et al. | 335/132 |
| 4,691,182 | A | 9/1987 | Mrenna et al. | |
| 6,181,226 | B1 * | 1/2001 | Leone et al. | 335/35 |
| 6,249,197 | B1 * | 6/2001 | Zindler et al. | 335/202 |
| 6,445,274 | B1 * | 9/2002 | Malingowski et al. | 337/49 |
| 7,041,921 | B2 | 5/2006 | Kadan et al. | |

FOREIGN PATENT DOCUMENTS

| | | | |
|---|---|---|---|
| DE | 39 09 230 | A1 | 10/1990 |
| DE | 42 27 213 | A1 | 2/1994 |
| DE | 44 42 417 | C1 | 2/1996 |
| DE | 195 16 723 | C2 | 11/1996 |
| DE | 100 36 352 | | 2/2002 |
| DE | 202 14 922 | U1 | 11/2002 |
| DE | 102006005697 | | 8/2007 |
| EP | 1 131 836 | B1 | 9/2007 |
| WO | WO 01/22462 | | 3/2001 |

* cited by examiner

*Primary Examiner* — Edwin A. Leon
(74) *Attorney, Agent, or Firm* — Henry M. Feiereisen; Ursula B. Day

(57) ABSTRACT

A switching device has an input terminal and an output terminal for connection to electrical conductors, and two switching contacts which, when closed, close a current path between the input terminal and the output terminal. A disconnect device for disconnecting the two switching contacts is operatively connected to a short-circuit trigger device which is arranged in the region of the input terminal and triggers the disconnect device. The short-circuit trigger device includes a U-shaped yoke and a movable hinged armature, which simplifies the design.

30 Claims, 4 Drawing Sheets

SWITCHING DEVICE

CROSS-REFERENCES TO RELATED APPLICATIONS

This application claims the benefit of prior filed U.S. Provisional Application No. 61/033,906, filed Mar. 5, 2008, pursuant to 35 U.S.C. 119(e).

This application further claims the priority of Austrian Patent Application, Serial No. A 360/2008, filed Mar. 5, 2008, pursuant to 35 U.S.C. 119(a)-(d).

The contents of U.S. provisional Application No. 61/033,906 and Austrian Patent Application, Serial No. A 360/2008 are incorporated herein by reference in its entirety as if fully set forth herein.

BACKGROUND OF THE INVENTION

The present invention relates, in general, to a switching device.

The following discussion of related art is provided to assist the reader in understanding the advantages of the invention, and is not to be construed as an admission that this related art is prior art to this invention.

Switching devices of a type involved here disconnect a line network from the power grid in the event of a short-circuit in the line network to prevent further supply of electric current. Such switching devices therefore have a so-called short-circuit trigger device which, when triggered, triggers a mechanical disconnect device which disconnects the switching contacts of the switching device, thereby preventing additional current flow. Typically, the short-circuit trigger device operates mechanically on a mechanical trigger of the disconnect device.

Short-circuit trigger devices are predominately implemented as an electromagnetic device, for example, as an elongated cylindrical coil with an armature arranged inside the coil. In the event of a short-circuit, the current reaches several thousand amperes, causing the armature to move, thereby triggering the disconnect device. Disadvantageously, short-circuit trigger devices with an elongated cylindrical coil have a complex structure which is expensive to manufacture, and also require support for the armature inside the coil.

It would therefore be desirable and advantageous to provide an improved switching device which obviate prior art shortcomings and are simple in structure and yet reliable in operation.

SUMMARY OF THE INVENTION

According to one aspect of the invention, a switching device includes an input terminal and an output terminal for connection to electrical conductors, first and second switching contacts which, when closed, close a current path between the input terminal and the output terminal, a disconnect device operable to disconnect the first switching contact and the second switching contact, and a short-circuit trigger device comprising a U-shaped yoke and a movable hinged armature, with the short-circuit trigger device arranged in a region of the at least one input terminal and mechanically operatively connected with the disconnect device for triggering the disconnect device.

In this way, a switching device with a simple construction can be constructed. Compared to conventional devices, such switching devices can be manufactured with significantly greater tolerances, while ensuring full functionality and operational safety. Such switching device can therefore be manufactured inexpensively by using simple machines.

According to another advantageous feature of the present invention, the U-shaped yoke may be attached to a first conductor of the current path. Suitably, the first conductor can be associated with the input terminal or the output terminal. The hinged armature may be rotatably supported on the U-shaped yoke and may include a first lever arm, preferably with a planar contact surface for contacting the U-shaped yoke, and a second lever arm which may be formed as a trigger extension which at least indirectly triggers the disconnect device.

According to another advantageous feature of the present invention, the switching device may further include a hinged-armature spring which urges the second lever arm against a stop and which also urges the first lever arm away from the U-shaped yoke. The hinged-armature spring may be implemented as a torsion spring which is arranged about a rotation axle of the hinged armature, with a first leg of the hinged-armature spring engaging on a hook-shaped extension disposed on the second lever arm of the hinged armature. A second leg of the hinged-armature spring may be affixed on the U-shaped yoke. In addition, the switching device may include a compression spring operating in the direction of a rotation axle of the hinged armature and urging the hinged armature against the U-shaped joke.

Alternatively, the hinged-armature spring may be implemented as combination of a torsion spring and a compression spring which then urges the hinged armature against the U-shaped yoke in a direction of a rotation axle of the hinged armature.

The U-shaped yoke may have an extension extending along the second lever arm and forming the stop for the second lever arm.

According to another advantageous feature of the present invention, the switching device may further include an overcurrent trigger device which is mechanically operatively connected with the disconnect device for triggering the disconnect device. To this end, the overcurrent trigger device may include a bimetallic element which is attached to the first conductor associated with the input terminal or the output terminal and/or arranged inside a U-shaped opening of the U-shaped yoke. The switching device may be implemented as a circuit breaker.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 shows an axonometric exploded view of a preferred embodiment of a switching device of the invention in;

DETAILED DESCRIPTION OF PREFERRED EMBODIMENTS

Figure 1:
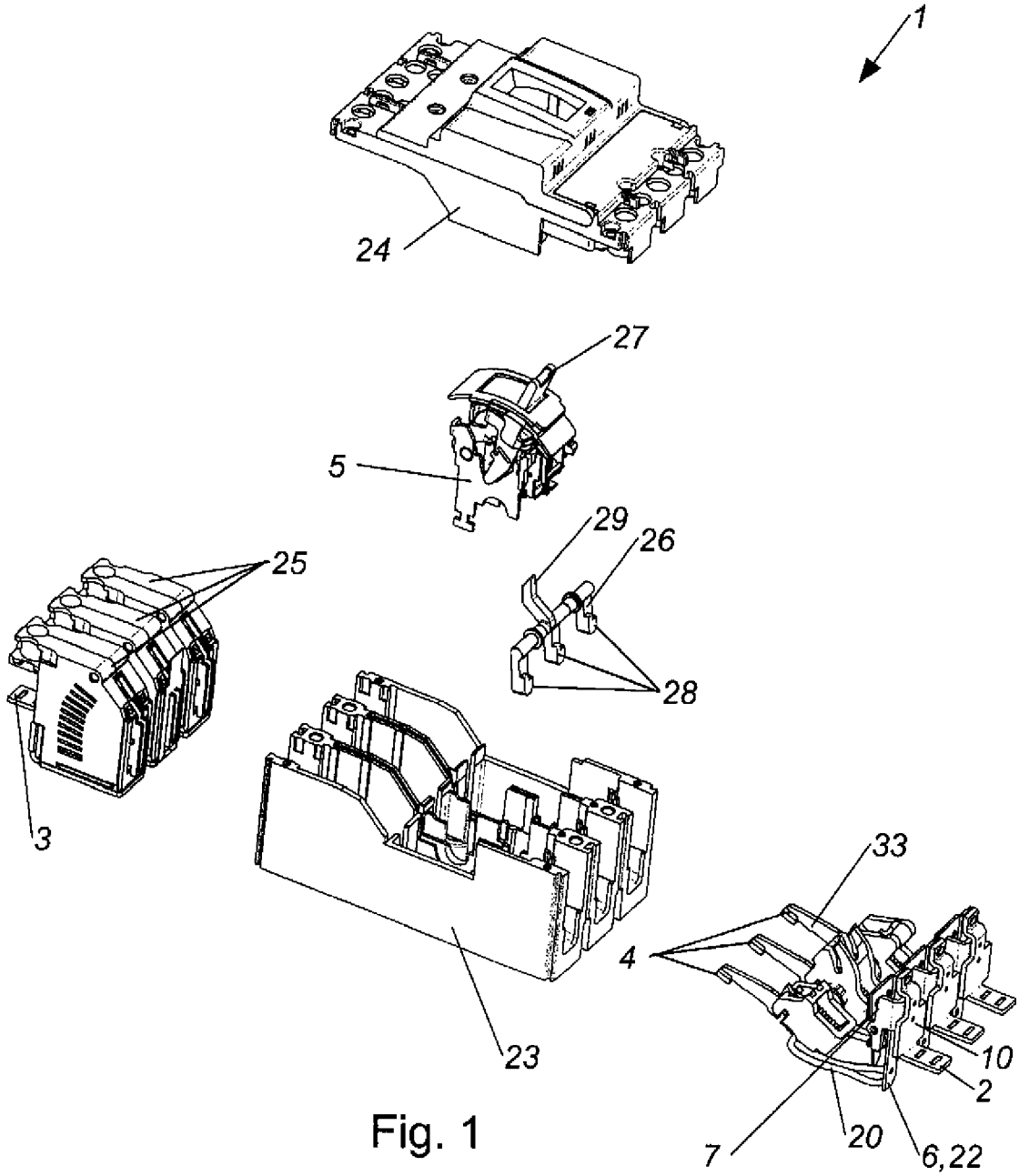
Figure 2:
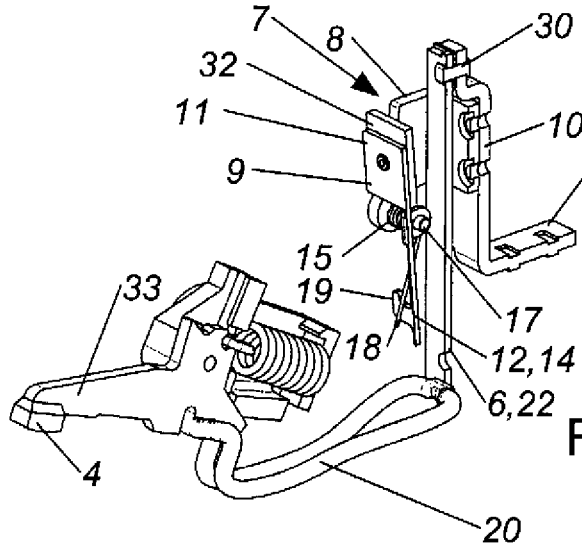
FIG. 2 shows a partial cross-sectional axonometric view of a preferred embodiment of a short-circuit trigger device and an overcurrent trigger device together with a first switching contact.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a switching device, generally designated by reference numeral 1 and configured in particular in the form of a circuit breaker. The switching device 1 has at least one input terminal 2 and at least one output terminal 3 for connection of electrical conductors, and a first switching contact 4 and a second switching contact. When the switching contacts 4 assume a closed position, they close a current path between the input terminal 2 and the output terminal 3. A disconnect device 5 is provided for disconnecting the first switching contact 4 and the second switching contact, and a short-circuit trigger device 7 is provided which is mechanically operatively connected with the disconnect device 5 for triggering the disconnect device 5. The short-circuit trigger device 7 is arranged in the region of the at least one input terminal 3, wherein the short-circuit trigger device includes at least one U-shaped yoke 8 and a movable hinged armature 9.

In this way, a switching device 1 with a simple construction can be realized. Compared to state-of-the-art devices, such switching device can be manufactured with significantly higher tolerances while still providing full functionality and operational safety. Such switching device 1 can therefore be manufactured cost-effectively using simple machines.

FIG. 1 shows a number of assemblies of a preferred embodiment of a switching device 1 according to the invention by way of an axonometric exploded view. The switching device 1 has three switching paths or current paths; however, any predeterminable number of switching paths or switchable current paths can be implemented. Preferably, switching devices 1 according to the invention with one, two, three or four current paths are contemplated. The number of input terminals 2 and output terminals 3 is then identical to the number of current paths. The Figures illustrate only those parts of the input terminals 2 and the output terminals 3 that are affixed to the housing. Each of the respective input terminals 2 and output terminals 3 typically includes, in addition to the illustrated parts, at least one terminal screw and preferably also a retaining washer moved by the terminal screw.

The switching device 1 includes a housing which is made of an insulating material and includes a lower housing shell 23 and an upper housing shell 24. In a closed position, the at least one first switching contact 4 is in contact with the at least one second switching contact, which is arranged inside the assembly of the arc quenching chamber 25, but is not visible in the illustrated embodiment.

Switching device 1 includes a short-circuit trigger device 7. FIGS. 1 to 4 show a currently preferred embodiment of an arrangement of an overcurrent trigger device 6 and a short-circuit trigger device 7, which will be described below; however, a short-circuit trigger device 7 can also be implemented alone, i.e. without an overcurrent trigger device 6.

The short-circuit trigger device 7 is formed of a U-shaped yoke 8 and a hinged armature 9, wherein the U-shaped yoke 8 is attached to a first conductor 10 of the current path which is preferably associated with the input terminal 2 and/or the output terminal 3.

In the event of a short-circuit, the currents through the switching device 1 attain values high enough for the U-shaped yoke 8 to attract the hinged armature 9, whereby the second lever arm 12 of the hinged armature 9 is deflected. The second lever arm 12 of the hinged armature 9 then triggers the disconnect device 5 and hence disconnects the switching contacts 4.

The U-shaped yoke 8 is riveted to the first conductor 10 with at least one rivet 30; however, the U-shaped yoke 8 can also be screwed or welded to the first conductor 10. The U-shaped yoke 8 is formed from a material which causes concentration and/or amplification of the electromagnetic effect, preferably paramagnetic or ferromagnetic materials, such as iron, steel other than stainless steel, or so-called dynamo sheet.

The hinged armature 9 is rotatably supported on the U-shaped yoke 8. The U-shaped yoke 8 has for this purpose two bearing openings 31 through which a rotation axle 17 of the hinged armature 9 extends. Such structure can be easily manufactured and easily and flexibly adjusted, and can therefore be manufactured with greater manufacturing tolerances. The hinged armature 9 has a first lever arm 11 and a second lever arm 12, wherein the first lever arm 11 has a contact surface 13 for contacting the U-shaped yoke 8, and the second lever arm 12 is formed as a trigger extension 14 for at least indirectly triggering the disconnect device 5.

The contact surface 13 is preferably formed as a planar surface. The contact surface 13 can be a surface formed with the hinged armature 9 as a single piece. Alternatively, like in the illustrated embodiment, the hinged armature 9 can also include a contact member 32 and the contact surface 13 can be part of the contact member 32. The contact member 32 is here preferably attached, in particular riveted, to the first lever arm 11. Preferably, at least the contact member 32 is made of a material corresponding to the materials employed for the U-shaped yoke 8.

The second lever arm 12 has a shape and dimensions so as to operate in the event of a short-circuit either directly on the disconnect device 5 for triggering the disconnect device 5 or moving at least one reversing lever 26 so that the reversing lever 26 triggers the disconnect device 5, as will be described in more detail below. The second lever arm 12, which is formed as a trigger extension 14 for at least indirectly triggering the disconnect device 5, does not operate directly on the disconnect device 5, but by way of the reversing lever 26. The hinged armature 9, in particular the second lever arm 12, is made of a non-magnetic material, preferably a material that includes copper or aluminum.

Figure 3:
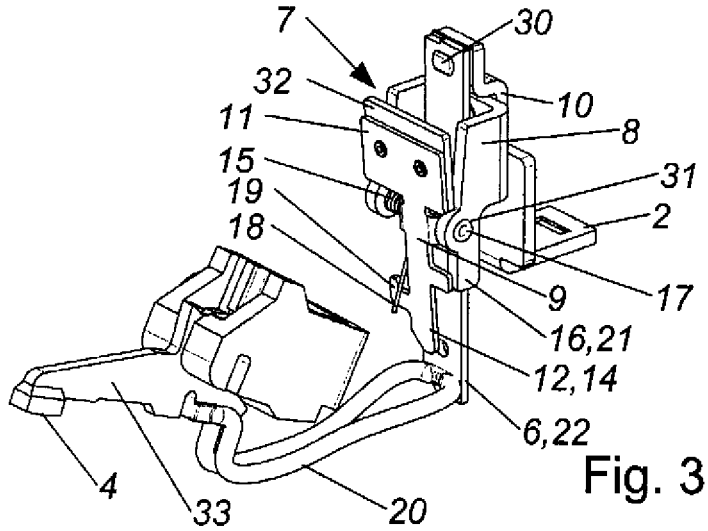
FIG. 3 shows an uncut axonometric view of the embodiment of FIG. 2.
Figure 4:
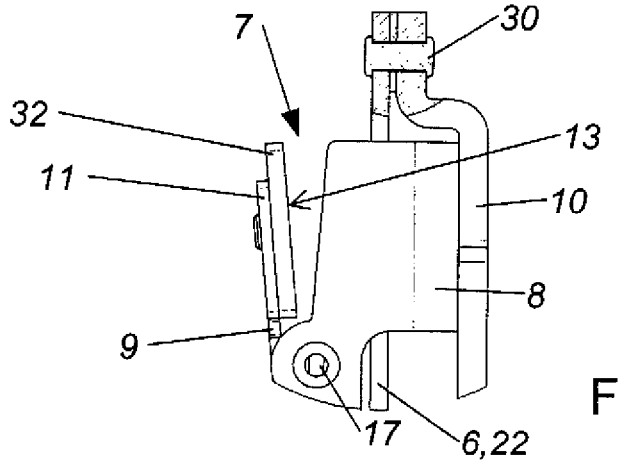
FIG. 4 shows a partially broken cross-sectional side view of a detail of the arrangement of FIG. 2.

The hinged armature 9 is urged by a hinged-armature spring 15 into a rest position, as schematically shown in FIG. 3, wherein in the rest position the hinged armature 26 is spaced from the U-shaped yoke 31. The rest position refers to the position assumed by the hinged armature 9 without a short-circuit in the line network. In particular, in the rest position the second lever arm 12 is urged against a stop 16, and the first lever arm 11 is urged away from the U-shaped yoke 8. The stop 16 is here formed by an extension 21 of the U-shaped yoke 8 having the same orientation as the second lever arm 12. With this structure several functions can be integrated in the U-shaped yoke 8, thus obviating the need for additional components.

Any type of spring can be used as hinged-armature spring 15, for example a leaf spring, a coil spring or a torsion spring. Preferably, the hinged-armature spring 15 is implemented as a torsion spring which is arranged about a rotation axle 17 of the hinged armature 9. By arranging the torsion spring about the rotation axle, the hinged-armature spring 15 is held captive, which would otherwise impair the function of the switching device 1. A first leg 18 of the hinged-armature spring 15 engages with an extension 21 arranged on the second lever arm 12 of the hinged armature 9. A second leg 35 of the hinged-armature spring 15 is attached to the U-shaped yoke 8, wherein the U-shaped yoke 8 may have a dedicated recess 36 for the second leg 35 of the hinged-armature spring 15. This is illustrated in FIG. 5.

Figure 5:
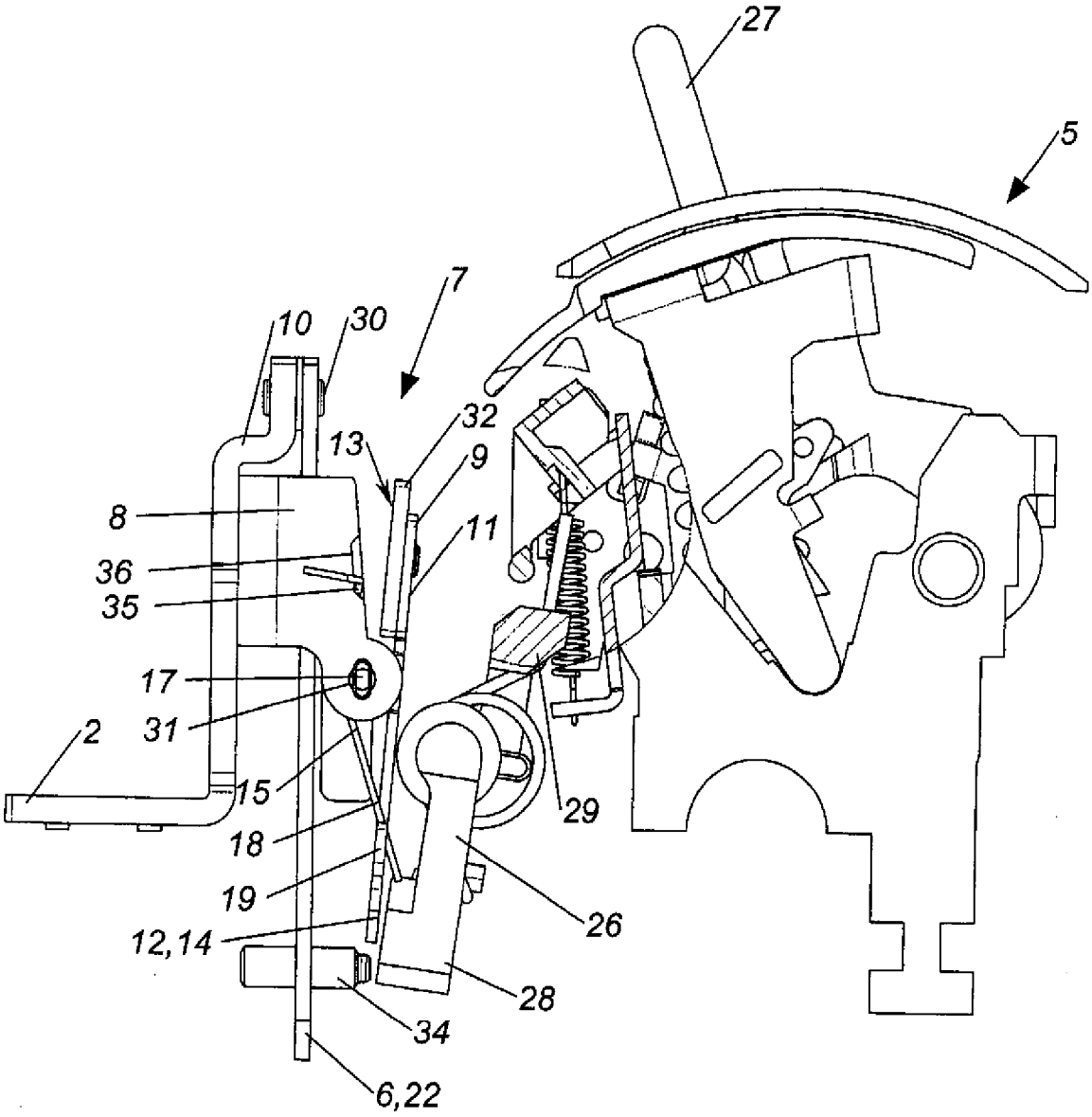
FIG. 5 shows a side view of an arrangement from a preferred embodiment of a short-circuit trigger device and an overcurrent trigger device with a disconnect device.

Although not shown in detail in FIG. 5, a compression spring may be provided to urge the hinged armature 9 against the U-shaped yoke 8. In this way, vibrations or humming caused by continuous movement of the hinged armature 9 between the legs of the U-shaped yoke 8 due to the AC current encountered in typical AC power grids can be eliminated. The compression spring operates in the direction of the rotation axle 17 of the hinged armature 9, thereby applying an essentially torque-free force on the hinged armature 9. This prevents the hinged armature 9 from jamming, which would limit its pivoting motion.

Figure 6:
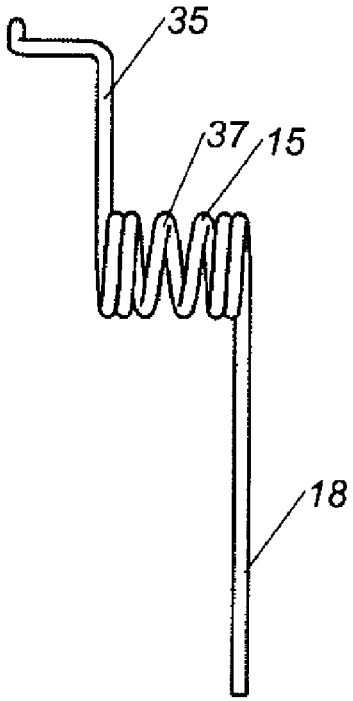
FIG. 6 shows an elevation of a preferred embodiment of a hinged-armature spring.
Figure 7:
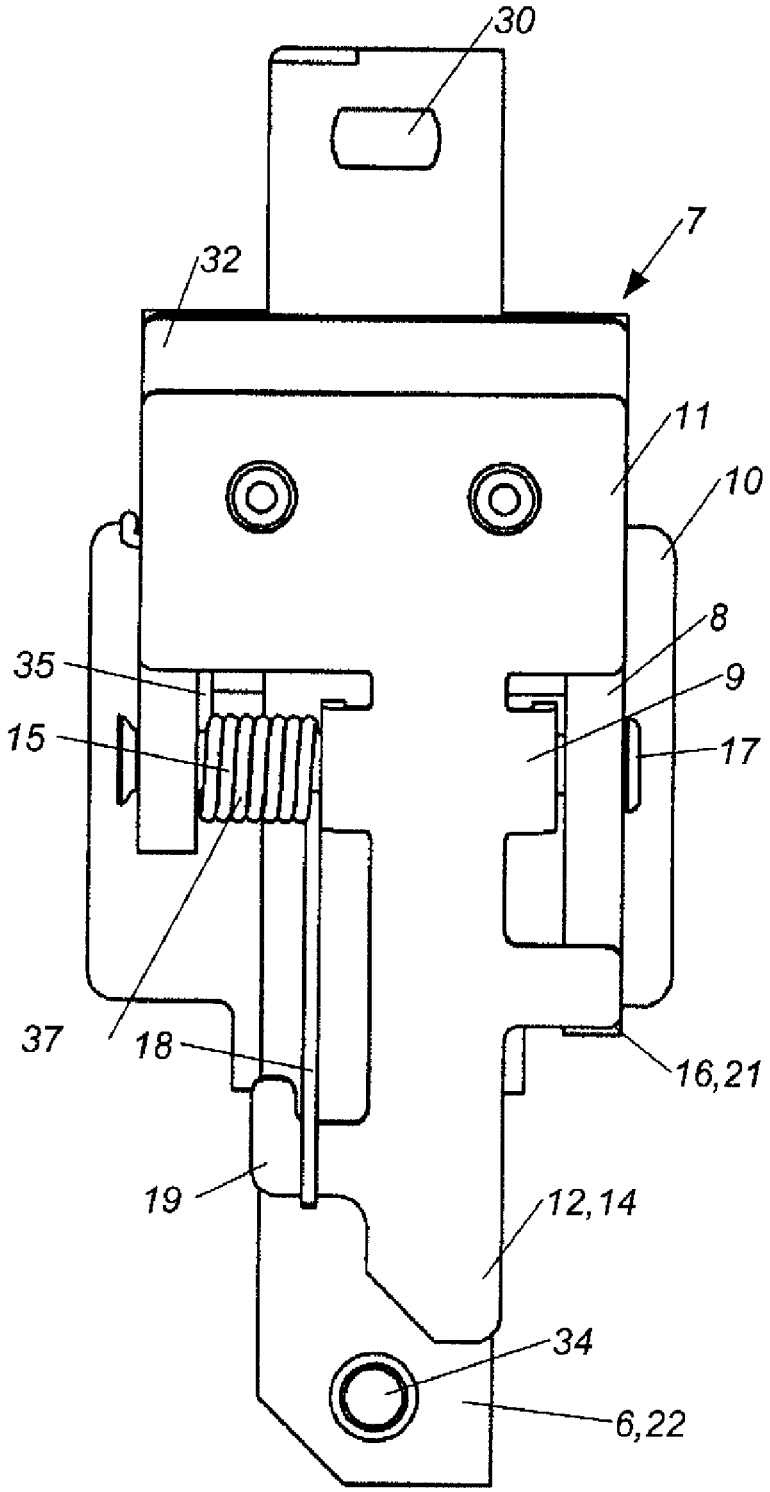
FIG. 7 shows a vertical section of the arrangement of FIG. 2.

As shown in particular in FIGS. 6 and 7, the hinged-armature spring 15 and the compression spring can be constructed as a single piece. As a result, the hinged-armature spring 15 is implemented as a combination torsion/compression spring and urges the hinged armature 9 against the U-shaped yoke 8 in the direction of the rotation axle 17 of the hinged armature 9. FIG. 6 shows a particularly preferred embodiment of such hinged-armature spring 15 formed as a combination torsion/compression spring in a substantially unbiased state. The helical center section 37 of the hinged-armature spring 15 operates here also as a compression spring. FIG. 7 shows an arrangement of a short-circuit trigger device 7 and an overcurrent trigger device 6, with a hinged-armature spring 15 according to FIG. 6. As clearly illustrated, the helical center section 37 of the hinged-armature spring 15 is compressed compared to the unbiased state of FIG. 6, with the hinged-armature spring 15 implemented as combination torsion/compression spring which presses or urges the hinged armature 9 against the U-shaped yoke 8. In this way, the hinged armature 9 is securely pressed against the stop 16 and prevented from moving away from the stop 16.

The switching device 1 further includes, in addition to the short-circuit trigger device, also an overcurrent trigger device 6. The overcurrent trigger device 6 includes a bimetallic element 22 which is preferably attached to the first conductor 10, whereby the bimetallic element 22 is preferably riveted to the first conductor 10 with at least one rivet 30. The other end of the bimetallic element 22, which is located opposite to the location where the bimetallic element 22 is attached to the first conductor 10, is connected to a flexible conductor 20, which is in turn connected to a contact support 33 on which the first switching contacts 4 are arranged. Current thus flows directly through the bimetallic element 22, i.e. it is part of the current path and heated directly by the current. Alternatively, the bimetallic element can also be heated—entirely or in addition—indirectly, for example by arranging a current-carrying conductor on the bimetallic element 22. The bimetallic element 22 is progressively bent with increasing heat-up due to the current. When the bimetallic element 22 is bent to a presettable degree, which is proportional to a predeterminable heat-up of the line network, the trigger extension 28 of the reversing lever 26 moves, which then causes—as mentioned above—triggering of the disconnect device 5 and therefore also disconnects the switching contacts 4.

As shown in FIGS. 1 to 4, the bimetallic element 22 is arranged inside a U-shaped opening of the U-shaped yoke 8, resulting in a particularly compact structure of the combination of an overcurrent trigger device 6 with a short-circuit trigger device 7.

The overcurrent trigger device 6 and/or the short-circuit trigger device 7 do not operate directly on the disconnect device 5, but rather via a reversing lever 26 which has, as illustrated in FIG. 5, at least one trigger extension 28 and at least one actuating extension 29. In a preferred embodiment of the switching device 1 of the invention, the second lever arm 12 of the hinged armature 9 operates on the trigger extension 28 of the reversing lever 26. A separate trigger extension 28 is provided for each switching path. The actuating extension 29 is provided for triggering the disconnect device 5.

The disconnect device 5 is implemented as a switch latch. The switch latch is a force-storing connecting member arranged between an actuating lever 27 and the switching contacts 4. In a first step, the switch latch is tensioned by moving the actuating lever 27 in a first direction, thereby tensioning a spring force store, which quickly and reliably disconnects the switching contacts 4 when the switch latch is triggered. The tensioning process is terminated by latching or locking the latch on a portion of the switch latch affixed to housing. In a second step, the switching contacts are closed by moving the actuating lever 27 in a second direction. The locking connection between the latch with the portion of the switch latch affixed to housing is formed so that a defined movement of the latch in a predeterminable direction unlocks the switch latch, thereby releasing the spring force store and disconnecting the switching contacts. When a movement of the overcurrent trigger device 6 and/or the short-circuit trigger device 7, in particular a movement of the hinged armature 9 and/or the bimetallic element 22, moves the reversing lever 26, the actuating extension 29 engages with the latch—following a presettable movement of the reversing lever 26—, and moves the latch far enough so as to disengage the locking connection with the part of the switch latch affixed to the housing, thereby unlocking the switch latch, releasing the spring force store and disconnecting the switching contacts 4.

Additional embodiments of the invention include only parts of the described features, whereby any combination of features, in particular of the different described embodiments, can be implemented.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A switching device, comprising:

an input terminal and an output terminal for connection to electrical conductors;

first and second switching contacts which, when closed, close a current path between the input terminal and the output terminal;

a disconnect device operable to disconnect the first switching contact and the second switching contact;

a short-circuit trigger device comprising a U-shaped yoke and a movable hinged armature, said short-circuit trigger device arranged in a region of the at least one input terminal and mechanically operatively connected with the disconnect device for triggering the disconnect device, and a compression spring which urges the hinged armature against the U-shaped joke, wherein the compression spring operates in the direction of a rotation axis of the hinged armature.

2. The switching device of claim 1, wherein the U-shaped yoke is attached to a first conductor of the current path.

3. The switching device of claim 1, wherein the hinged armature is rotatably supported on the U-shaped yoke.

4. The switching device of claim 1, wherein the hinged armature comprises a first lever arm and a second lever arm.

5. The switching device of claim 4, wherein the first lever arm has a planar contact surface for contacting the U-shaped yoke.

6. The switching device of claim 4, wherein the second lever arm is formed as a trigger extension which at least indirectly triggers the disconnect device.

7. The switching device of claim 4, further comprising a hinged-armature spring which urges the second lever arm against a stop and which urges the first lever arm away from the U-shaped yoke.

8. The switching device of claim 7, wherein the hinged-armature spring is implemented as a torsion spring which is arranged about a rotation axle of the hinged armature.

9. The switching device of claim 7, wherein a first leg of the hinged-armature spring engages on a hook-shaped extension disposed on the second lever arm of the hinged armature.

10. The switching device of claim 7, wherein a second leg of the hinged-armature spring is affixed on the U-shaped yoke.

11. The switching device of claim 7, wherein the hinged-armature spring is implemented as combination of a torsion spring and the compression spring.

12. The switching device of claim 7, wherein the U-shaped yoke has an extension extending along the second lever arm, said extension forming the stop for the second lever arm.

13. The switching device of claim 1, further comprising an overcurrent trigger device which is mechanically operatively connected with the disconnect device for triggering the disconnect device.

14. The switching device of claim 13, wherein the overcurrent trigger device comprises a bimetallic element which is attached to a first conductor associated with the input terminal or the output terminal.

15. The switching device of claim 14, wherein the bimetallic element is arranged inside a U-shaped opening of the U-shaped yoke.

16. The switching device of claim 1, wherein the switching device is implemented as a circuit breaker.

17. The switching device of claim 2, wherein the first conductor is associated with the input terminal or the output terminal.

18. A switching device, comprising:

an input terminal and an output terminal for connection to electrical conductors;

first and second switching contacts which, when closed, close a current path between the input terminal and the output terminal;

a disconnect device operable to disconnect the first switching contact and the second switching contact;

a short-circuit trigger device comprising a U-shaped yoke and a movable hinged armature having a first lever arm and a second lever arm, said short-circuit trigger device arranged in a region of the at least one input terminal and mechanically operatively connected with the disconnect device for triggering the disconnect device, and a hinged-armature spring implemented as combination of a torsion spring and a compression spring, with the hinged-armature spring urging the second lever arm against a stop and urging the first lever arm away from the U-shaped yoke.

19. The switching device of claim 18, wherein the U-shaped yoke is attached to a first conductor of the current path.

20. The switching device of claim 18, wherein the hinged armature is rotatably supported on the U-shaped yoke.

21. The switching device of claim 18, wherein the first lever arm has a planar contact surface for contacting the U-shaped yoke.

22. The switching device of claim 18, wherein the second lever arm is formed as a trigger extension which at least indirectly triggers the disconnect device.

23. The switching device of claim 18, wherein a second leg of the hinged-armature spring is affixed on the U-shaped yoke.

24. The switching device of claim 18, wherein the U-shaped yoke has an extension extending along the second lever arm, said extension forming the stop for the second lever arm.

25. The switching device of claim 18, further comprising an overcurrent trigger device which is mechanically operatively connected with the disconnect device for triggering the disconnect device.

26. The switching device of claim 25, wherein the overcurrent trigger device comprises a bimetallic element which is attached to a first conductor associated with the input terminal or the output terminal.

27. The switching device of claim 26, wherein the switching device is implemented as a circuit breaker.

28. The switching device of claim 19, wherein the first conductor is associated with the input terminal or the output terminal.

29. The switching device of claim 26, wherein the bimetallic element is arranged inside a U-shaped opening of the U-shaped yoke.

30. The switching device of claim 29, wherein a first leg of the hinged-armature spring engages on a hook-shaped extension disposed on the second lever arm of the hinged armature.

* * * * *